US008861769B2

(12) United States Patent
Lin

(10) Patent No.: US 8,861,769 B2
(45) Date of Patent: Oct. 14, 2014

(54) HEADPHONE DEVICE

(71) Applicant: Giga-Byte Technology Co., Ltd., New Taipei (TW)

(72) Inventor: Yin Yu Lin, New Taipei (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 12 days.

(21) Appl. No.: 13/732,338

(22) Filed: Dec. 31, 2012

(65) Prior Publication Data

US 2014/0185855 A1 Jul. 3, 2014

(51) Int. Cl.
*H04R 25/00* (2006.01)
*H04R 1/10* (2006.01)

(52) U.S. Cl.
CPC ..... *H04R 1/1091* (2013.01)
USPC ..... 381/370; 381/374

(58) Field of Classification Search
CPC ..... H04R 1/105–1/1075; H04R 1/1033; H04R 1/101; H04R 5/0335; H04R 5/06
USPC ..... 381/370, 376–378, 383, 371, 379, 74
See application file for complete search history.

(56) References Cited

U.S. PATENT DOCUMENTS

| | | | | |
|---|---|---|---|---|
| 5,117,465 | A * | 5/1992 | MacDonald | 381/379 |
| 5,329,592 | A * | 7/1994 | Altman | 381/379 |
| 6,880,174 | B2 * | 4/2005 | Prokop | 2/209 |
| 7,120,247 | B1 * | 10/2006 | Wade | 379/430 |

* cited by examiner

*Primary Examiner* — Curtis Kuntz
*Assistant Examiner* — Sunita Joshi
(74) *Attorney, Agent, or Firm* — Chun-Ming Shih

(57) ABSTRACT

A headphone device includes a first audio output module, a second audio output module, and a head module connected between the first and second audio output modules that are located at both ends of the head module respectively. The head module stays bent when in use and stays straight when in compact storage. Thus the form factor of the headphone device in compact storage is relatively smaller.

6 Claims, 5 Drawing Sheets

HEADPHONE DEVICE

BACKGROUND OF THE INVENTION

1. Field of the Invention

The present invention relates to a headphone device, especially to a headband-style headphone device whose form factor in compact storage is relatively smaller.

2. Description of Related Art

The earphone devices in the marketplace may be divided into three categories according to the appearances: headband-style headphones, in-ear headphones, and ear hook headphones.

Headband-style headphones are usually designed to fully encompass the ears with earpads to block outside noises and seal music in, and thus offer a relatively fabulous sound quality. They are also rigid and shatterproof yet with the drawbacks of large form factor and very limited collapsibility resulting in inconveniences of carrying them around. Hence, such headphones are the least portable and therefore much more suitable for home use.

In-ear headphones are configured to be snugly inserted into the ear canals with the part of the audio output transducers. They are portable, lightweight, and fit for many portable electronic devices like Walkman and cell-phones. As a plus, they have small form factor. However, the only drawback thereof is that listeners cannot be isolated satisfactorily from outside noise or sound.

Ear hook headphones attaching around the ears have size (form factor) and sound quality between the headband-style headphones and the in-ear headphones. Because the audio output transducers thereof are hung around the ears, better acoustic isolation and sound quality than the in-ear type can be provided. However, in terms of sound quality and audio performance, the headband-style headphone is the best choice.

So there is a need to develop a headband-style headphone free of the above drawbacks without sacrificing the sound quality.

SUMMARY OF THE INVENTION

In view of this, the present invention solves the above problems by providing a headband-style headphone device whose form factor is relatively smaller when in compact storage.

In one embodiment, a headphone device includes a first audio output module, a second audio output module, and a head module. The first audio output module outputs an audio signal of a left channel. The second audio output module outputs an audio signal of a right channel. The head module connected between the first audio output module and the second audio output module that are located at both ends of the head module respectively. The head module stays bent when in use to allow a user listen to audio signals comfortably, and stays straight when in compact storage and can be accommodated into the first and the second audio output modules as far as possible, thus the form factor of the headphone device is reduced.

In this embodiment, the head module can further include a flexible metal strip made of robust steel so that the flexible metal strip stays bent or straight normally when the headphone device is in use or in compact storage. And the flexible metal strip can be forced to deform and stays bent to fit the user's head.

In another embodiment, a headphone device includes a first audio output module, a second audio output module, a head module, a wireless module, a volume control module and a cord. The wireless receiving module is electrically connected to the first audio output module for receiving and transforming a wireless signal from an electronic device into an audio signal which is to be transmitted to the second audio output module through the cord.

The present invention is advantageous basically because when the headphone device is in compact storage, the head module can be straightened and part of it can be accommodated into the first and second audio output modules as far as possible. Thus the form factor of the headphone device can be reduced greatly and becomes highly portable.

These and other objectives of the present invention will no doubt become obvious to those of ordinary skill in the art after reading the following detailed description of the preferred embodiments that is illustrated in the various figures and drawings.

DETAILED DESCRIPTION OF THE PREFERRED EMBODIMENTS

Figure 1:
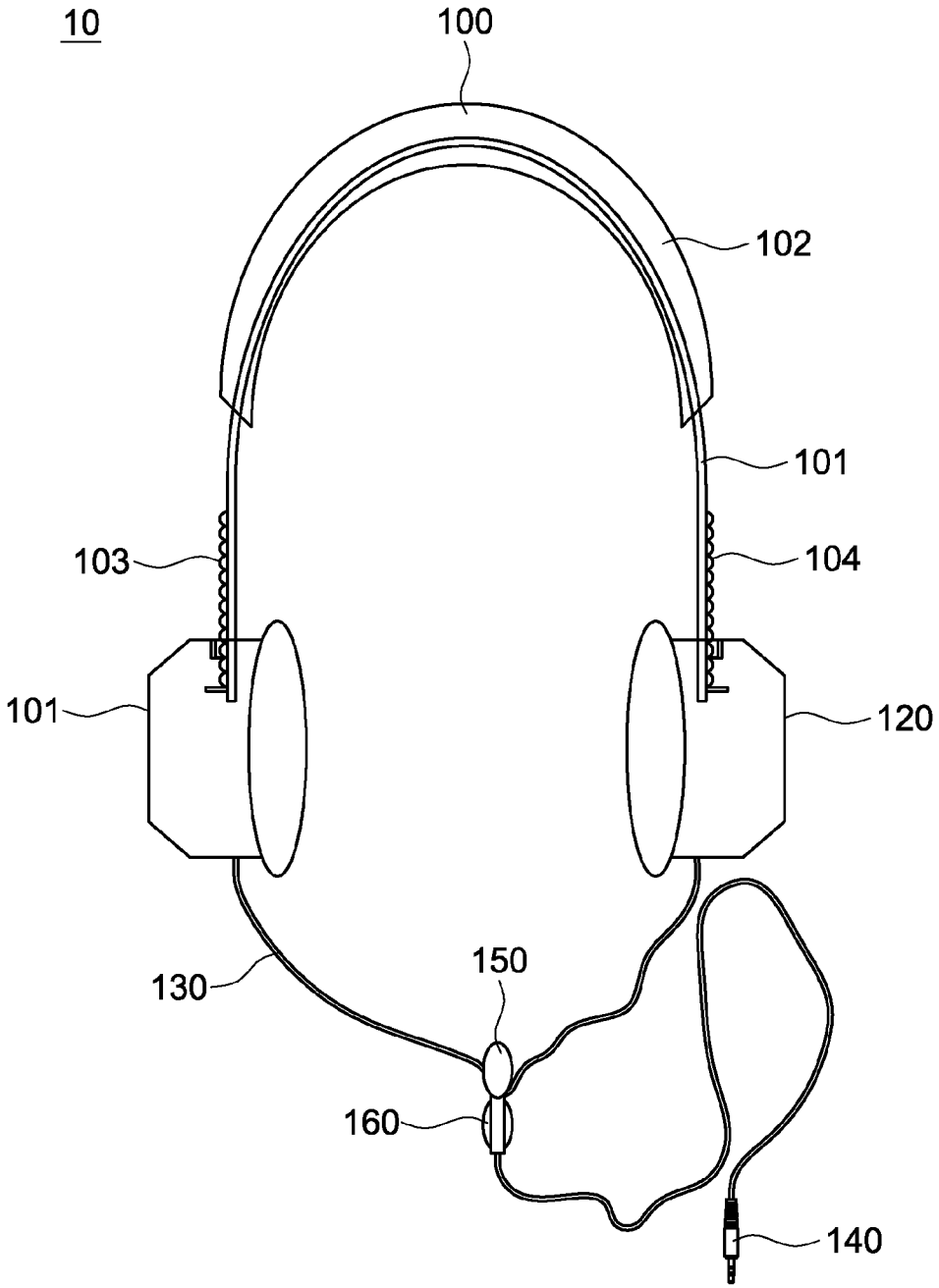
FIG. 1 is a diagram of a headband-style headphone device of a first embodiment of the present invention in a service mode.

FIG. 1 is a diagram of a headband-style headphone device 10 of a first embodiment of the present invention in a service mode. The headband-style headphone device 10 includes a head module 100, a first audio output module 110, a second audio output module 120, a cord 130, an earphone plug 140, an audio input module 150, and a volume control module 160.

The head module 100 includes a flexible metal strip 101 which can be made of but not limited to robust stainless steel. One of ordinary skill in the art can select any deformable metal as material of the flexible metal strip 101 and determine the form factor thereof by manipulating thickness and length for example according to practical requirements.

The flexible metal strip 101 can stay straight or deform to stay bent normally, and the overall shape of the head module 100 is dependent thereon.

Furthermore, the flexible metal strip 101 has a plurality of first projections 103 on one end and a plurality of second projections 104 on the other end. One of the first projections 103 and one of the second projections 104 respectively correspond and are buckled to a first concave 111 disposed in the first audio output module 110 and a second concave 121 disposed in the second audio output module 120. Thus the relative position of the head module 100, the first audio output module 110 and the second audio output module 120 can be fixed either in use (service mode) or in compact storage (storage mode).

When the headphone device 10 is put to use, the flexible metal strip 101 is forced to deform and stay bent to fit the user's head, so that the user may feel comfortable with the headphone device 10.

Besides, the headphone device 10 further includes an audio input module 150 and a volume control module 160. The audio input module 150 can be connected to the first audio output module 110 or the cord 130. The audio input module 150 transforms sound wave (acoustic signal) of the user into an electronic signal and transmits it to an electric device, such as a hands-free phone or a SKYPE phone, through the cord 130 and the earphone plug 140. The headphone device 10 including the audio input module 150 brings about convenience for the user in interactive applications.

The volume control module 160 allows the user to control the volume of the headphone device 10 directly rather than through the complicated interface of the electronic device. The designs of the audio input module 150 and the volume control module 160 are well-known to one of ordinary skill in the art and will not give a tautological description herein.

Figure 2:
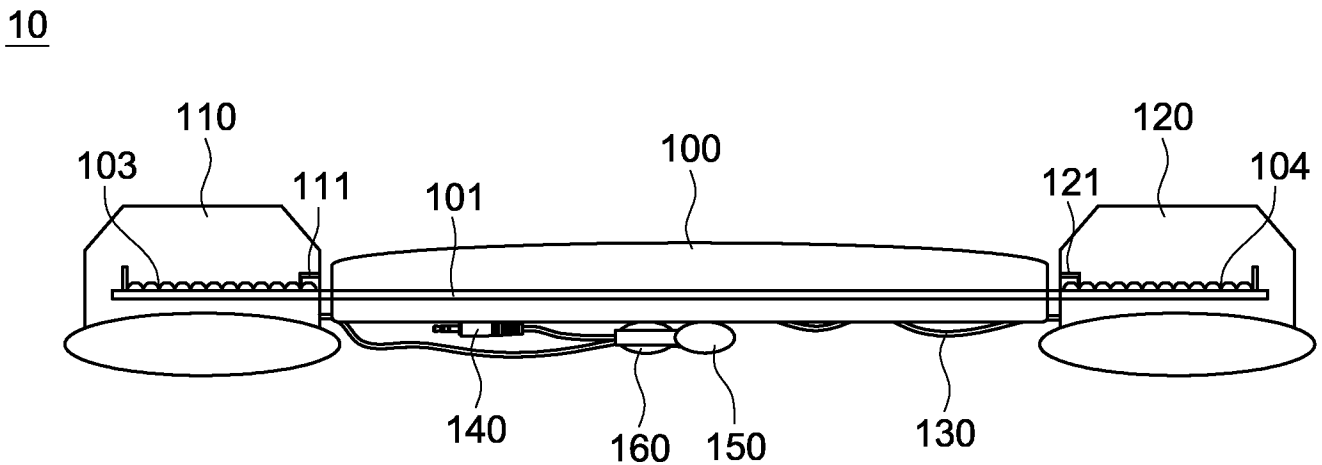
FIG. 2 is a diagram of the headphone device of the first embodiment of the present invention in compact storage.

FIG. 2 is a diagram of the headphone device 10 of the first embodiment of the present invention in compact storage. The head module 100 further includes a head cushion module 102 surrounding middle of the flexible metal strip 101. The head cushion module 102 has a lining made of soft and recoverable material such as foam, a wrap made of a sheet of soft material such as plastics or artificial fiber, and a bottom made of material which is allowed to be fastened and unfastened repeatedly such as Velcro hook and loop tapes (not shown). The material of the bottom functions to wrap a part of the cord 130, the earphone plug 140, the audio input module 150 and the volume control module 160 into the head cushion module 102 when the flexible metal strip 101 stays straight (in compact storage).

Figure 3C:
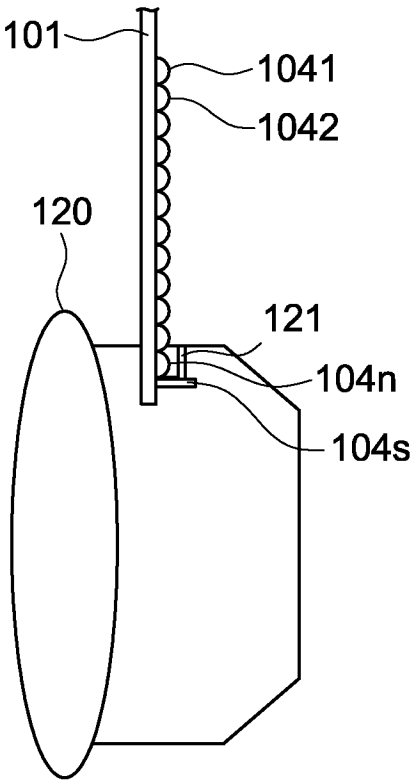
FIG. 3A to FIG. 3C are structure diagrams of an audio output module of the headphone device of the first embodiment of the present invention.
Figure 3B:
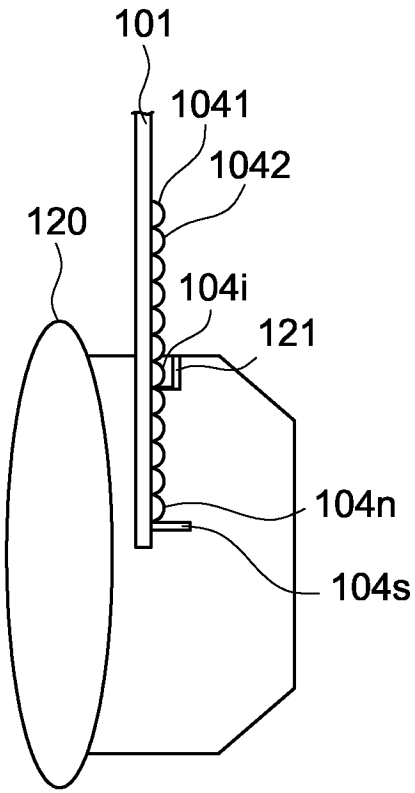
Figure 3A:
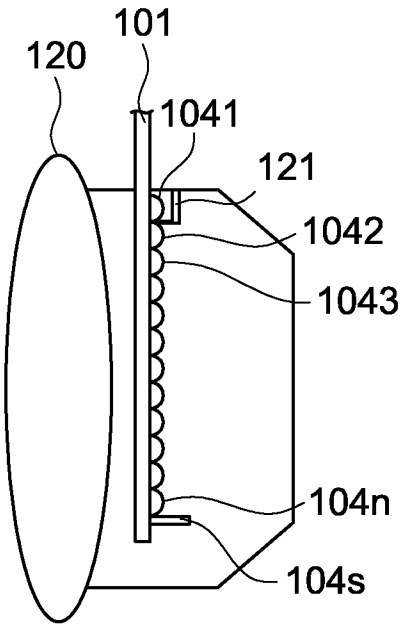

FIG. 3A to FIG. 3C are structure diagrams of an audio output module of the headphone device of the first embodiment of the present invention particularly showing how the second projections 104 correspond and are buckled to the second concave 121. It is appreciated that since the connection between first audio output module 110 and the head module 100 is the same as that between the second audio output module 120 and the head module 100, only the second audio output module 120 is described for illustration in the following paragraphs.

In FIG. 3A to FIG. 3C, one end of the flexible metal strip 101 has the plurality of the second projections 104 in which a projection 1041 is closest to the head cushion module 102, projections 1042 and 1043 are the second and third closest ones respectively, and the like, and what is closest to the end of the flexible metal strip 101 is a projection 104*n* where n is an integer larger than one.

Next, how the headphone device 10 is turned into a compact storage form is depicted by referring to FIG. 3A. As a first step, force is applied to deform the flexible metal strip 101 such that the head module 100 stays straight. Then, the relative position of the first audio output module 110, the second audio output module 120 and the flexible metal strip 101 is adjusted by buckling the projection 1041 which is closest to the head cushion module 102 to the second concave 121. Thus the flexible metal strip 101 can be accommodated into the second audio output modules 120 as far as possible, and the form factor of the headphone device 10 is reduced.

How the headphone device 10 is turned into a service mode is depicted by referring to FIG. 3B. As a first step, force is applied to the flexible metal strip 101 such that the head module 100 stays bent. Then, one of the projection 104*i* is selected to be buckled to the second concave 121 according to the head size and the customary practice for example, where i is an integer ranging from 1 to n, so that the head module 100 is exposed from the first and second audio output modules 110 and 120 in a length suitable for the listener.

Referring to FIG. 3C, a protective projection 104*s* is provided next to the projection 104*n*. When the projection 104*n* closest to the end of the flexible metal strip 101 is buckled to the second concave 121 and the user want to further lengthen the head module 100 by exposing more part of the head module 100 from the first and second audio output modules 110 and 120, the protective projection 104*s* will serve to impede from increase of the length of the head module 100 that is exposed from the first and second audio output modules 110 and 120, thereby preventing the flexible metal strip 101 from coming off the second audio output module 120 and breaking down the headphone device 10.

Figure 4:
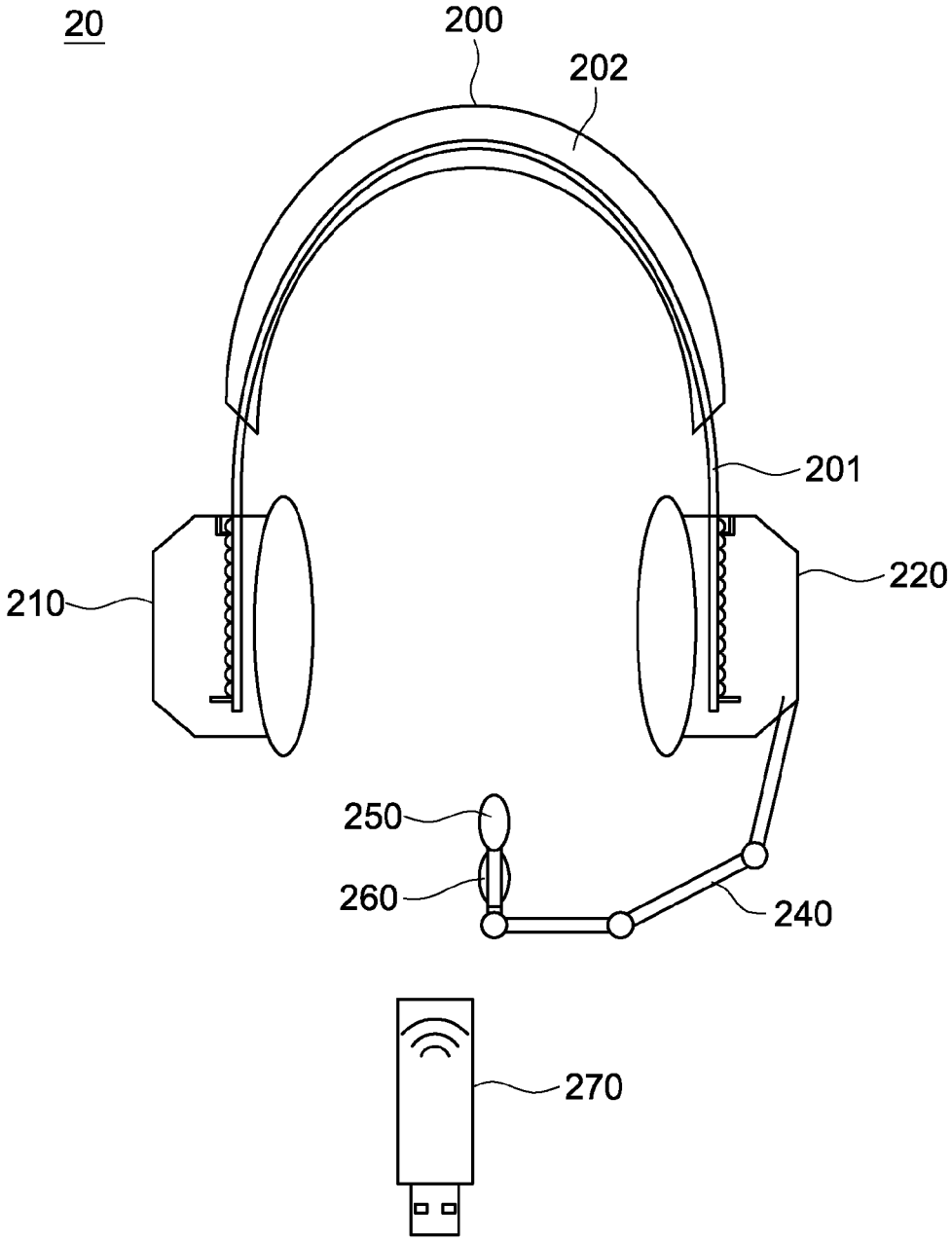
FIG. 4 is a diagram of the headphone device of a second embodiment of the present invention in a service mode.

FIG. 4 shows a headphone device 20 of a second embodiment of the present invention in a service mode. The headphone device 20 transmits signals wirelessly and includes a head module 200, a first audio output module 210, a second audio output module 220, a cord, a connecting module 240, an audio input module 250, a volume control module 260 and a wireless module 270.

In more detail, the head module 200 has a head cushion module 202 and a flexible metal strip 201 having a plurality of first projections 203 and a plurality of second projections 204. One of the first projections 203 and one of the second projections 204 respectively correspond and are buckled to a first concave 221 disposed in the first audio output module 210 and a second concave 231 disposed in the second audio output module 220, so that the head module 200 is exposed from the first and second audio output modules 210 and 220 in an adjustable length.

The difference between the first and second embodiments is that the headphone device 20 receives from an electronic device electronic signals through the wireless module 270. The electronic signals are then transformed into wireless radio-frequency ones to be transmitted to the first and second audio output modules 210 and 220. Besides, signal processing modules (not shown) are incorporated in the first and second audio output modules 210 and 220 for transforming the wireless radio-frequency signals into audible sound waves.

Alternatively, the signal processing module is incorporated only in the first audio output module 210, and the sound waves are transmitted therefrom to the second audio output module 220 through the cord which is connected to the first and second audio output modules 210 and 220 respectively.

It is noted that the audio input module 250 and the volume control module 260 in this embodiment function in the same way as the audio input module 150 and the volume control module 160 in the first embodiment respectively and will not be described further here. Also, in this embodiment, the connecting module 240 which can be accommodated into the second audio output module 220 is employed to connect the audio input module 250 and the volume control module 260 to the headphone device 20.

When the headphone device 20 is in a service mode, the connecting module 240 can be extended from the second audio output module 220 in a flexible way to make the audio input module 250 approximate to the listener's mouth as a voice receiver. Furthermore, the volume control module 260 is disposed under the audio input module 250 to allow an easy control of the volume of the first and second audio output modules 210 and 220.

Figure 5:
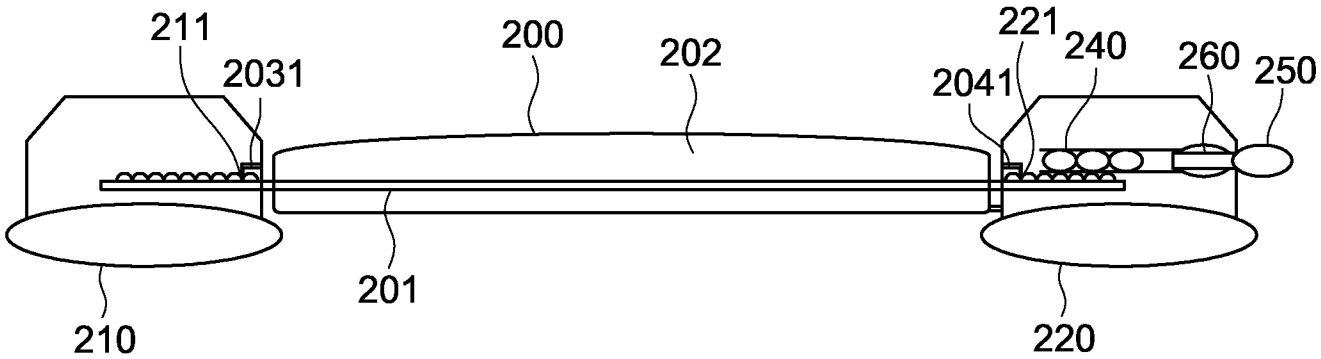
FIG. 5 is a diagram of the headphone device of the second embodiment of the present invention in compact storage.

FIG. 5 shows the headphone device 20 of the second embodiment of the present invention in compact storage. The connecting module 240 can be accommodated into the second audio output module 220 in a straight form. The projections 2031 and 2041 which are closest to the head cushion module 202 can be buckled to the first concave 211 and the second concave 221 respectively. Thus the flexible metal strip 201 can be accommodated into the first and second audio output modules 210 and 220 as far as possible, and the form factor of the headphone device 20 is reduced.

It is noted that the embodiments are used as an exemplary interpretation of a headphone device without any intention to limit the scope of the present invention. Those skilled in the art may modify the appearance and the function of the headphone device according to the user's requirements.

The present invention is advantageous because, on one hand, the flexible metal strip can be forced to stay straight and the head module becomes compact on the whole; on the other hand, part of the head module can be accommodated into the first and second audio output modules as far as possible and the form factor of the headphone device is thus reduced. In short, the headphone device of the present invention is collapsible and the form factor is adjustable to meet the user's requirements.

The aforementioned descriptions represent merely the preferred embodiment of the present invention, without any intention to limit the scope of the present invention thereto. Various equivalent changes, alterations, or modifications based on the claims of the present invention are all consequently viewed as being embraced by the scope of the present invention.

What is claimed is:

1. A headphone device, comprising:

a first audio output module, including a first concave disposed in the first audio output module;

a second audio output module, including a second concave disposed in the second audio output module;

a head module connected between the first audio output module and the second audio output module that are located at both ends of the head module respectively; the head module further comprising a flexible metal strip including a plurality of first projections one of which is buckled to the first concave, a plurality of second projections one of which is buckled to the second concave, and two protective projections disposed at two ends of the flexible metal strip; and a head cushion module, surrounding middle of the flexible metal strip, wherein the head cushion module has a lining made of a recoverable material, a wrap made of a soft material, and a bottom made of a material which is allowed to be fastened and unfastened repeatedly;

wherein the head module stays bent when in use and stays straight when in compact storage;

wherein when the projections closest to the ends of the flexible metal strip are buckled to the first concave and the second concave, the protective projections prevent the flexible metal strip from coming off the first audio output module and the second audio output module;

wherein when the headphone device is in the compact storage, one of the first projections and one of the second projections that are closest to the head cushion module are buckled to the first concave and the second concave respectively.

2. The headphone device of claim 1, wherein the flexible metal strip is made of steel so that the flexible metal strip stays bent or straight normally.

3. The headphone device of claim 1, further comprising a cord and an earphone plug, wherein the cord is connected to the first audio output module, the second audio output module and the earphone plug respectively, and the earphone plug is to be connected to an electronic device for receiving an audio signal from the electronic device and transmitting the audio signal to the first audio output module and the second audio output module through the cord.

4. The headphone device of claim 1, wherein the head module further comprises a piece of a head cushion module having a Velcro tape and wrapped around the flexible metal strip and attached to the head cushion module.

5. The headphone device of claim 3, further comprising an audio input module electrically connected to the cord for receiving and transforming sound wave into an electronic signal which is to be transmitted to the electronic device through the cord and the earphone plug.

6. The headphone device of claim 5, further comprising a wireless receiving module electrically connected to the first audio output module and a cord connected to the first audio output module and the second audio output module, wherein the wireless receiving module receives and transforms a wireless signal from an electronic device into an audio signal which is to be transmitted to the first audio output module first and then to the second audio output module through the cord.

* * * * *